US006074765A

United States Patent [19]

Pugh

[11] Patent Number: 6,074,765

[45] **Date of Patent: *Jun. 13, 2000**

[54] GRINDING ROD CHEMISTRY AND METHOD OF HEAT TREATMENT TO ENHANCE WEARABILITY

[75] Inventor: Robert William Pugh, Sherwood Park, Canada

[73] Assignee: Stelco Inc., Hamilton, Canada

[ * ] Notice: This patent is subject to a terminal disclaimer.

[21] Appl. No.: 09/089,526

[22] Filed: Jun. 3, 1998

[51] Int. Cl.[7] ..... C21D 9/08

[52] U.S. Cl. ..... 428/610; 148/334; 148/595; 148/639; 148/902

[58] Field of Search ..... 148/334, 595, 148/600, 639, 902; 420/105; 428/610

[56] References Cited

U.S. PATENT DOCUMENTS

| | | | |
|---|---|---|---|
| 3,669,762 | 6/1972 | Takeo et al. | 148/595 |
| 3,799,766 | 3/1974 | Weigel | 420/105 |
| 3,997,375 | 12/1976 | Franceschina et al. | 148/590 |
| 4,376,528 | 3/1983 | Ohshimatani et al. | 266/114 |
| 4,589,934 | 5/1986 | Glodowski et al. | 148/334 |
| 4,840,686 | 6/1989 | Arnett et al. | 198/334 |
| 5,902,423 | 5/1999 | Pugh | 148/334 |
| 5,972,135 | 10/1999 | Pugh | 148/595 |

*Primary Examiner*—George Wyszomierski
*Attorney, Agent, or Firm*—Alston & Bird LLP

[57] ABSTRACT

A grinding rod chemistry enhances wearability and durability of a steel rod and comprises levels of carbon to achieve a surface hardness in excess of 55 Rockwell C and levels of chromium which achieve significant depth in the formed outer martensite shell. The grinding rod has a core greater than 99% pearlite with a hardness less than 45 Rockwell C and the end portions of the rod are soft and have a hardness less than 35 Rockwell C. The steel bar of the selected chemistry is treated by reheating to above its austenitising temperature, transferring with minimal cooling to an open tubular quench vessel while securing the bar in the vessel to minimize bar warping, introducing quench water into the inlet end of the vessel and passing the liquid through the vessel to ensure uniform heat removal. The outer martensite shell is tempered by allowing the bar to soak back after quenching. The bar end portions are reheated in a furnace to elevate the end portions above the austenitising temperature and air cooling each end portion to provide the engineered end portion hardness of less than 35 Rockwell C.

15 Claims, 2 Drawing Sheets

FIG. 3.
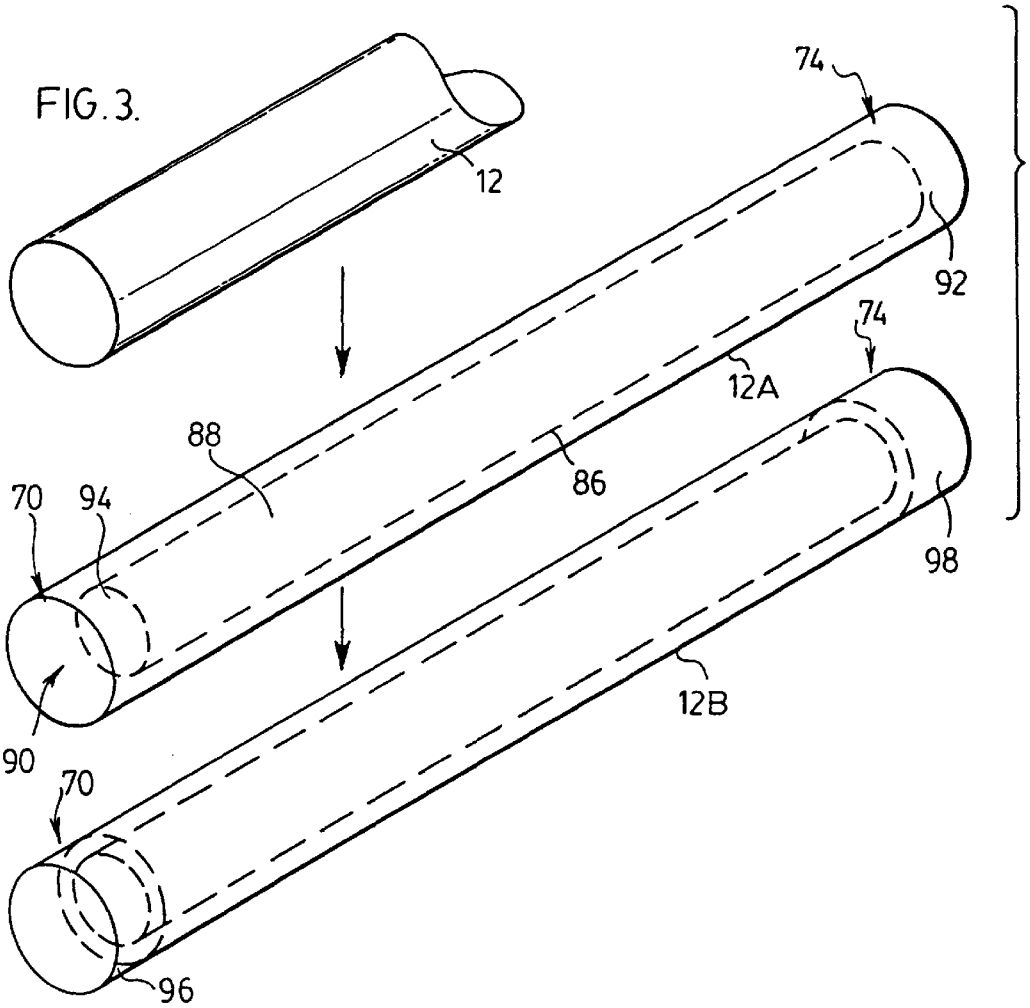
FIG. 2.
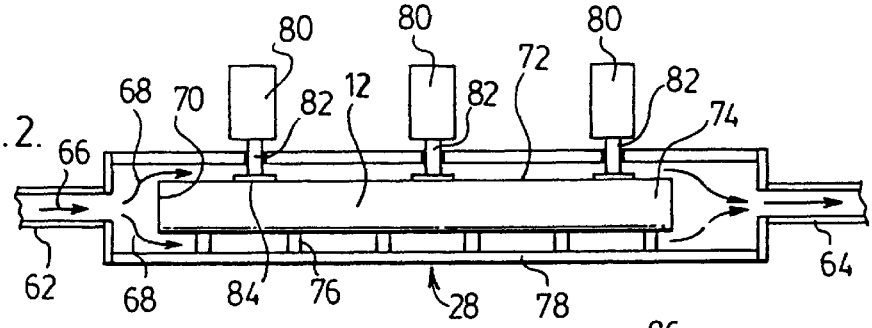
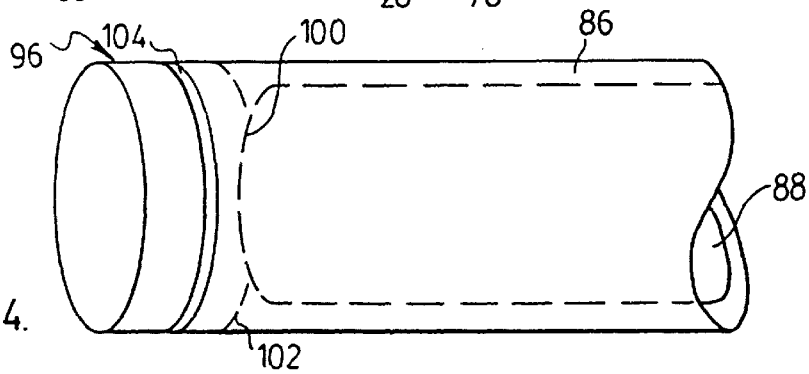
FIG. 4.

GRINDING ROD CHEMISTRY AND METHOD OF HEAT TREATMENT TO ENHANCE WEARABILITY

FIELD OF THE INVENTION

This invention relates to a chemistry to enhance wearability of grinding rods and heat treatment techniques to enhance wearability.

BACKGROUND OF THE INVENTION

Various technologies are available for manufacturing grinding rods for use in grinding mills, such as in ore crushing, stone crushing and the like. Grinding rods are usually 3 to 6 meters in length depending upon the size of the grinding device and have diameters which usually range from 7 to 10 cm. It has been found that the usefull life of a grinding rod may be improved if it has a hard outer shell usually of martensitic microstructure and relatively soft end portions which are substantially of pearlitic microstructure. The soft end portions minimize rod spalling and splitting thereof and reduce breakage and wear of the rod mill liners. A discussion of grinding rods having soft end portions may be found in U.S. Pat. No. 4,589,934 as well as the several other U.S. patents discussed in the background of that U.S. patent.

In an attempt to improve grinding rod longevity by way of heat treatment, the chemistry of the steel in the grinding rod may be modified such as described in U.S. Pat. No. 4,840,686. The modification of the chemistry in the steel of the grinding rod results in the rod core having a bainitic microstructure with less than 10% pearlite and a core hardness of at least about 40 Rockwell C, or 40 HRC. It is thought that making rods with the proper selection of molybdenum and chromium to provide a rod core of mostly bainite enhances the wear rate of the rod by nearly 20% over that of a conventional heat treated rod. The selected chemistry and heat treatment ensures that the core is of the harder bainite where softer pearlitic material is to be avoided.

The rods, as made in accordance with either of U.S. Pat. Nos. 4,589,934 and 4,840,686 are quenched after heating by passing the rod through a quench spray. The quenching of the rod is commenced inwardly of the leading end of the rod and the quench spray turned off short of the trailing end of the rod. It is thought that by not applying quench water spray to the leading end and trailing end of the rod, softer end portions are developed. Also as taught, the rod may have to pass through multiple quench zones in order to achieve the desired extent of quenching to ensure the formation of the harder martensitic shell. As is described in U.S. Pat. No. 4,589,934, minor amounts of quench water travelling along the rod surface towards either the leading or trailing end portion may create a wash effect, thereby expediting cooling of the end portion resulting in the formation of end portions which can have a hardness greater than 30 and perhaps up to 45 or 50 HRC. To minimize this effect, the commencing of the quench water spray and terminating of the quench water spray are activated or deactivated a considerable distance from each end. A significant portion of the rod end is not treated resulting in a fairly large transition zone between the quench portion of the rod which has the martensitic structure and the untreated end portion of the rod which has the pearlitic structure. In practice, the softer end portions of the rod may extend upwards of 30 cm or more with a very gradual transition from the hard shell to the softer portion. This results in a grinding rod having a greater length of softer end portion with consequent increased wear.

Although grinding rods having greater surface hardness and core hardness have greater wearability, it has been found that durability, which includes breakage of these rods is less than adequate particularly in severe grinding environments. In accordance with an aspect of this invention a grinding rod is provided which overcomes the above problems even in more severe grinding environments.

SUMMARY OF THE INVENTION

In accordance with an aspect of the invention, a grinding rod chemistry for enhancing wearability and durability of a steel rod comprises:

carbon 0.70–1.00% by weight;

manganese 0.60–1.00% by weight;

silicon 0.10–0.40% by weight;

chromium 0.25–1.04% by weight;

molybdenum 0.01–0.25% by weight; and the balance being essentially iron and with the proviso that a combination of carbon, molybdenum and chromium within the above ranges are selected as follows to provide a non-bainitic core:

a) at the lower 0.7% carbon with a minimum of 0.01% molybdenum, chromium is equal to or less than 1.04% and with a maximum of 0.25% molybdenum, chromium is equal to or less than 0.43%; and b) at the upper 1.00% carbon, with a minimum of 0.01% molybdenum, chromium is equal to or less than 0.80% and with a maximum of 0.25% molybdenum, chromium is equal to or less than 0.28%.

In accordance with another aspect of the invention a grinding rod having the above chemistry is characterized by:

i) a core of greater than 99% pearlite having a hardness less than 45 Rockwell C;

ii) an outer shell of tempered martensite having a hardness of greater than 55 Rockwell C and a uniform annular thickness greater than about 1.25 cm; and iii) a 10 cm to 15 cm soft end and having a hardness less than 35 Rockwell C.

In accordance in yet another aspect of the invention, a grinding rod of the above characteristics may be produced by the process comprising:

i) reheating a formed steel bar to above its austenitising temperature in a controlled manner to produce a reheated bar of substantially uniform reheat temperature;

ii) transferring with minimal cooling said reheated bar to an open tubular quench vessel which is capable of enclosing an entire bar length, closing said vessel to provide a quench liquid tight seal about said bar while securing said bar in said vessel to minimize bar warping in said vessel during quenching;

iii) introducing quench water into an inlet end of said vessel and passing said quench liquid along said vessel at high surface velocities exceeding 4 meters per second relative to bar surface to minimize thereby production of steam along the bar length and ensure uniform heat removal and removing quench water at an outlet end of said vessel;

iv) quenching said bar in said vessel for a period of time which provides a bar surface equalization temperature when removed from said vessel of less than 350° C. and greater than 150° C. to provide a uniform annular layer for said hard outer shell of tempered martensite and said softer core of pearlite where the end surface hardness is consistent with said hard tempered martensite shell, said developed uniform outer shell of martensite producing uniform residual stress contributing to rod straightness;

v) reheating each end portion of said bar in a furnace to elevate, in a controlled manner, said less than 15 cm end portion including its core to the austenitising temperature, air cooling each said end portion to provide said engineered end portion hardness of less than 35 Rockwell C.

In accordance with an aspect of the invention, a process for producing a grinding rod having a core of greater than 99% pearlite having a hardness less than 45 Rockwell C and an outer shell of tempered martensite having a hardness greater than 55 Rockwell C and a uniform annular thickness greater than about 1.25 cm, said process comprises:

i) reheating a formed steel bar to above its austenitising temperature in a controlled manner to produce a reheated bar of substantially uniform reheat temperature, said steel bar having the following chemistry:
carbon 0.70–1.00% by weight;
manganese 0.60–1.00% by weight;
silicon 0.10–0.40% by weight;
chromium 0.25–1.04% by weight;
molybdenum 0.01–0.25% by weight; and
balance essentially iron; and with the proviso that a combination of carbon, molybdenum and chromium within the above ranges are selected as follows to provide a non-bainitic core:
a) at the lower 0.7% carbon with a minimum of 0.01% molybdenum, chromium is equal to or less than 1.04% and with a maximum of 0.25% molybdenum, chromium is equal to or less than 0.43%; and
b) at the upper 1.00% carbon, with a minimum of 0.01% molybdenum, chromium is equal to or less than 0.80% and with a maximum of 0.25% molybdenum, chromium is equal to or less than 0.28%.

ii) transferring with minimal cooling said reheated bar to an open tubular quench vessel which is capable of enclosing an entire bar length, closing said vessel to provide a quench liquid tight seal about said bar while securing said bar in said vessel to minimize bar warping in said vessel during quenching;

iii) introducing quench water into an inlet end of said vessel and passing said quench liquid along said vessel at high surface velocities exceeding 4 meters per second relative to bar surface to minimize thereby production of steam along the bar length and ensure uniform heat removal and removing quench water at an outlet end of said vessel;

iv) quenching said bar in said vessel for a period of time which provides a bar surface equalization temperature when removed from said vessel of less than 350° C. and greater than 150° C. to provide a uniform annular layer for said hard outer shell of tempered martensite and said softer core of pearlite where the end surface hardness is consistent with said hard tempered martensite shell, said developed uniform outer shell of martensite producing uniform residual stress contributing to rod straightness.

BRIEF DESCRIPTION OF THE DRAWINGS

Preferred embodiments of the invention are described with respect to the drawings, wherein:

FIG. 2 is a schematic cross-section through a representative type of bar quenching device, such as described in U.S. Pat. No. 4,376,528, the subject matter of which is incorporated herein by reference;

FIG. 3 illustrates the steps in heat treating the bar; and

FIG. 4 is an enlarged view of an end portion of the grinding rod.

DETAILED DESCRIPTION OF THE PREFERRED EMBODIMENTS

Figure 1:
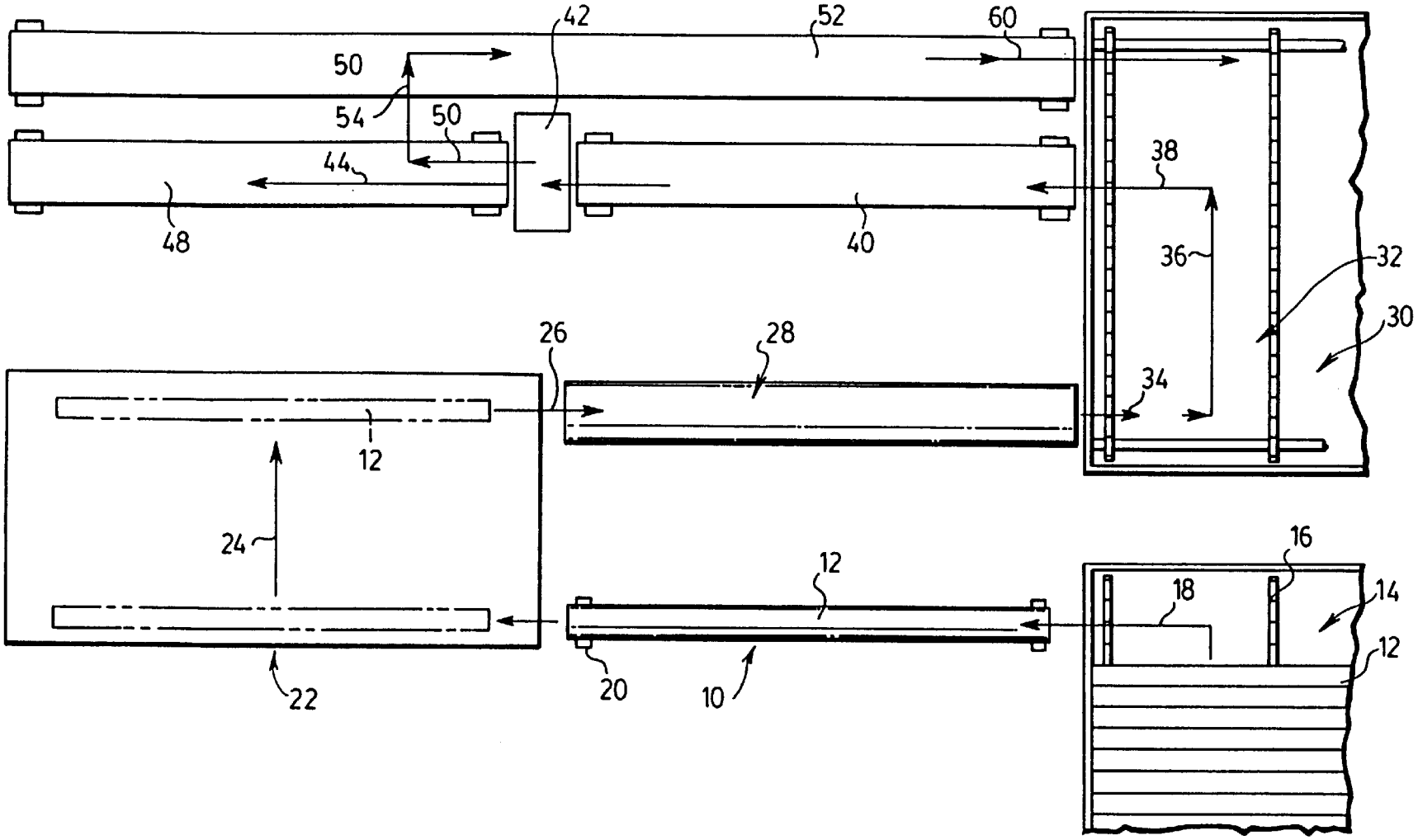
FIG. 1 is a schematic of a heat treating line for heat treating and selftempering steel bar to form grinding rods with soft ends.

Applicant has found that by the selection of a chemistry for the steel bar which is heat treated to form a grinding rod not only can the wearability be increased but as well as the stresses can be indirectly controlled to maintain durability at acceptable levels. The durability in the grinding rod is achieved by having a tougher perilitic core which is capable of resisting the higher stresses in the harder martensitic shell. We have surprisingly found that the toughness of the pearlitic core is sufficient to prevent breakage due to the higher stresses generated in the harder outer martensitic shell which are transferred to the pearlitic core. In order to achieve the harder tempered outer martensitic shell the amount of carbon used in the steel alloy is increased and usually falls in the range of 0.7 to 1.0% by weight to achieve an outer shell hardness greater than 55 Rockwell C and up to 65 Rockwell C depending upon the manner of heat treatment. Manganese is included at a level in the range of about 0.6 to 1.0% by weight and silicon is included at a level of about 0.1 to 0.4% by weight. In order to achieve an annular uniform layer of martensite of substantial thickness, significant amounts of chromium are used to achieve the depth of martensitic layer. The amount of chromium ranges from about 0.28 to 1.04% by weight. Molybdenum in the rod is equal to or less than 0.25% by weight which in combination with the above amount of chromium ensures a pearlitic core. It has been found that, with these ranges for the chemistries, some guidance is required to ensure a proper selection from these ranges to achieve the desired wearability and durability characteristics in the rod. In this respect, the chemistry selection is based on the proviso that a combination of carbon, molybdenum and chromium within the above ranges are selected as follows to provide a non-bainitic core:

a) at the lower 0.7% carbon with a minimum of 0.01% molybdenum, chromium is equal to or less than 1.04% and with a maximum of 0.25% molybdenum, chromium is equal to or less than 0.43%; and b) at the upper 1.00% carbon, with a minimum of 0.01% molybdenum, chromium is equal to or less than 0.80% and with a maximum of 0.25% molybdenum, chromium is equal to or less than 0.28%.

This chemistry for the rod also lends the rod heat treatment to providing grinding rods having the desirable soft ends of hardness less than 35 Rockwell C and the soft tough rod core of greater than 99% pearlitic and a hardness less than 45 Rockwell C while at the same time providing an outer tempered martensitic shell having a hardness greater than 55 Rockwell C and up to 65 Rockwell C and greater. By virtue of the selected chemistry and a preferred type of heat treatment, the martensitic shell is of a uniform annular thickness preferably greater than about 1.25 cm and up to 1.60 cm or more. The preferred method of heat treating with this chemistry is capable of providing soft end portions of a length of about 10 cm to 15 cm and having a hardness less than 35 Rockwell C.

The engineered heat treating of the end portions can be modified to provide intermediate portions of a hardness less than 25 Rockwell C to thereby provide a ring with improved crack arresting properties. It has been found that with this invention a grinding rod is produced which is relatively straight by virtue of the process and chemistry of this invention providing uniform stresses in the outer annular shell of tempered martensite.

The preferred process for heat treating the rod comprises quenching the rod in an elongate vessel which delivers high velocity quench water along the length of the bar to rapidly cool the bar with minimal generation of steam on the bar surface. Such rapid controlled quench along the length of the bar develops a uniform layer of martensite having the higher hardness in the range of about 55 to 65 Rockwell C while developing uniform balances stresses around and along the martensitic shell to provide the desired rod straightness. After the rapid controlled quench, the bar is withdrawn from the quench vessel and tempered by allowing the bar to soak back to an equalization temperature after quenching.

In this regard, a representative heat treating line 10 for reheating steel bar, quenching a steel bar and subsequently heat treating each bar end portion is shown in FIG. 1. Individual bars 12 are advanced on a rack 14 which may include a chain/dog advancing mechanism 16. Each individual bar 12 is advanced off the rack 14 in the direction of line 18. The bar may be passed on suitable rollers 20 into a reheat furnace 22 which is temperature controlled to ensure that the individual bars 12, as they advance in the direction of arrow 24 across the furnace, are reheated to the preferred austenitising temperature. Each bar, at the desired reheat temperature, is transferred out of the furnace 22 in the direction of arrow 26 into a quenching vessel 28 which is described in more detail with respect to FIG. 2. The quenching vessel 28 delivers the high velocity quench water to develop a uniform annular layer of martensite which is tempered when the bar is allowed after exiting the quench vessel to attain a soak back or equalization temperature in the range of less than 350° C. and greater than 150° C. The quenched bar is transferred to rack 30 with advancing chain/dog system 32. The bar, as advanced in the direction of arrow 36 after having been removed from the quench vessel 28 in the direction in the arrow 34, is advanced in the direction of arrow 38 onto a bar conveyor system 40. The leading end of the bar is inserted into a furnace 42 which may be an annular induction furnace to reheat a specified portion of the bar end which is preferably less than 15 cm in length. The end portion is heated to its austenitising temperature and then passed through the annular induction furnace 42 in the direction of arrow 44, so that the end portion may be air cooled and thereby provide an engineered end portion hardness of less than 35 Rockwell C. After the bar end is removed from the furnace in the direction of arrow 44 and transferred to conveyor 48, the other end of the bar is then positioned in the furnace 42. The other bar end is now reheated in the furnace 42 to its austenitising temperature and withdrawn in the direction of arrow 50 to permit air cooling thereof. The bar is transferred to conveyor 52 in the direction of arrow 54. The bar with both ends softened is transferred from the conveyor 52 in the direction of arrow 60 onto the rack 30 for transport to a final cooling station where the bars are inspected, bundled, identified and color coded as required.

The aspects of the process, which provide the significant advantages in the subject grinding rod, may be realized in the selected chemistry, in the type of quench vessel 28 and in the separate engineered end heat treatment to provide a well defined softened end portion of a specified length less than 15 cm.

As shown in FIG. 2, the quench vessel 28 may be of the type, for example, as described in U.S. Pat. Nos. 4,376,528 or 3,997,375. Although both of these patents describe quenching systems for quenching tubular pipe where water flows along the inside and the outside of the pipe, the same system may be used to heat treat solid bar, where significant unexpected advantages flow from use of the tubular pipe quench system in forming the harder grinding rods. With reference to FIG. 2, a schematical cross-section of the quench vessel 28 includes a water inlet 62 and a water outlet 64. Water is forced through the inlet in the direction of arrow 66 where it flows outwardly in the direction of arrow 68 over the end portion 70 of the bar 12. The water then flows along the surface 72 of the bar and over the downstream end 74 where the water converges and flows out through the outlet 64. The bar 12 may be supported on suitable supports 76 which may be spaced apart along the bottom wall 78 of the vessel, or may be one continuous support along the bottom wall. In any event, the supports 76 make point contact with the bar 12 to maximize the surface area 72 exposed to the water flowing longitudinally over the bar 12. Preferably, the quench vessel 28 includes hydraulic pistons 80 which have water sealed rams 82 extending through the vessel. The rams include plates 84 which contact the surface 72 and thereby clamp the bar within the vessel to further resist bar warping during the quenching process. As taught in U.S. Pat. No. 4,376,528, the velocity of the quench water is maintained at or above a minimum operating level to ensure that steam does not develop at the bar surface and thereby optimizes the rate of heat transfer from the bar to the quenching water. Cooling water preferably travels at a minimum surface velocity relative to the bar of about 4 meters per second and may flow at surface velocities much greater, for example, up to 15 meters per second. The ideal flow velocity is usually in the range of about 5 meters to 8 meters per second. At these velocities, a uniform outer shell of martensite is produced where the bar is quenched in the vessel for a period of time which provides a bar surface equalization temperature, when removed from the vessel 28, of less than 350° C. and greater than 150° C. We have determined that quenching the bar in a vessel of the type shown in FIG. 2 ensures that any vapor produced at the bar surface is instantly flushed away to provide a uniform and rapid quenching of the bar surface. This type of quenching ensures the development of a uniform outer shell of martensite. By virtue of this quenching process as well as the clamping of the bar in the vessel, we have unexpectedly found that the bar, after cooling, maintains rod straightness. Such rod straightness has been found preferably to be less than 1.25 cm deviation from a straight line along entire rod length. It is thought that the uniform quenching of the bar surface develops a uniform compressive force in the martensite shell to maintain rod straightness.

Within the range of the above surface velocities, the length of time that the bar is quenched in the vessel is for a defined period. Preferably, the quench water temperatures range from 10° C. to 40° C. at vessel inlet, although it is appreciated that other quench water temperatures may be selected as long as the quenching achieves the desired rate of quench to provide the desired martensite layer. For quench water temperatures in the range of 30° C. to 35° C., quench times range from 110 seconds to 160 seconds for rods having diameters ranging from about 7.5 cm to about 10 cm. With this period of quenching and novel chemistry, it has been found that the tempered martensite shell has a radial depth of at least about 1.25 cm and usually about 1.6 cm or greater.

As shown in FIG. 3, the bar 12 is reheated to its austenitising temperature. As is appreciated by those skilled in the art, the austenitising temperature will depend on the chemistry of the material selected from the following ranges, Carbon 0.70–1.00% by weight Manganese 0.60–1.00% by weight Silicon 0.10–0.40% by weight Chromium 0.25–1.04% by weight Molybdenum 0.01–0.25% by weight The selection from the above ranges requires a degree of guidance as offered by the proviso that a combination of carbon, molybdenum and chromium within the above ranges are selected as follows to provide a non-bainitic core:

a) at the lower 0.7% carbon with a minimum of 0.01% molybdenum, chromium is equal to or less than 1.04% and with a maximum of 0.25% molybdenum, chromium is equal to or less than 0.43%; and b) at the upper 1.00% carbon, with a minimum of 0.01% molybdenum, chromium is equal to or less than 0.80% and with a maximum of 0.25% molybdenum, chromium is equal to or less than 0.28%.

In accordance with this proviso in the chemistry selection, it is apparent that, as the carbon content rises, with lower amounts of molybdenum the amount of chromium is higher and with higher amounts of molybdenum, the amount of chromium is relatively lower. Hence, for a 0.7% carbon chemistry, the molybdenum and chromium may range from 0.01% Mo and 1.04% Cr to 0.25% Mo and 0.43% Cr; and for a 1.0% carbon chemistry, the molybdenum and chromium may range from 0.01% molybdenum and 0.80% chromium to 0.25% molybdenum and 0.28% chromium. With these ranges, one skilled in the art can readily interpolate the concentrations of molybdenum and chromium for carbon contents between 0.7 and 1.00%. This range for the selected molybdenum and chromium provides many advantages including achieving the necessary balance between the amounts of molybdenum and chromium to avoid formation of a bainitic core and to allow a selection which optimizes product cost with varying alloy costs.

With this chemistry, the preferred austenitising temperature is in the range of about 775° C. to about 870° C. When the bar is quenched in vessel 28, a uniform layer 86 of martensite is formed along the entire length of the quenched bar 12A. The selected chemistry ensures the formation of the deep layer of martensite. The core portion 88, on the other hand, during the heat treatment develops a pearlitic structure in the range of at least about 99% pearlite. The ends 70 and 74 of the bar have hardened portions 90 and 92 inwardly of the end, as depicted by the termination of the core portion at transition line 94. The bar ends 70 and 74 are then reheated in a suitable furnace which is preferably an induction coil furnace. A selected length of each end portion is reheated, preferably less than 15 cm where the end portions 96 and 98 are reheated to their austenitising temperature without appreciably heating the rest of the bar. The end portions are then, as described with respect to FIG. 1, air cooled to provide end portions which are of substantially pearlitic microstructure and have a hardness of less than 35 Rockwell C. With appropriate control of the end heating, the end portions may have a hardness of less than 30 Rockwell C.

In order to minimize the effects that hydrogen has on the rolled bar stock, it is understood that the bar may be subjected to a degassing step. This step minimizes hydrogen build-up in the bar to enhance crack resistance of the bar during heat treatment and in the rod during use.

As shown in FIG. 4, the soft end portion 96 extends from beyond the transition zone 100, which defines the end of the pearlitic core 88, and the end of the martensitic shell 86 as defined by dotted line 102. The softer end 96, which as already noted, may have a hardness considerably less than 35 Rockwell C may be treated in a manner to include an intermediate annular ring 104 which may have a hardness less than 25 Rockwell C to provide thereby a softer end with improved crack arresting properties. This small annular ring of softer material assists the end portion 96 in arresting any cracks which attempt to propagate along the rod.

It is appreciated that various processing parameters may change depending upon the size of the bar, the chemistry of the bar, the structure of the quench vessel, the supports in the quench vessel and the clamps for the bar in the quench vessel. It is appreciated that such modifications are well within the purview of those skilled in the art to achieve all of the benefits and advantages of this invention which, in summary, are as follows. By providing an engineered rod soft end portion, which is formed in a step subsequent to the quenching step, this ensures that the rod end is well defined and is considerably shorter than what is produced by the prior art processes. Quenching the bar with high velocity water quench stream ensures a uniform quenching of the bar surface and hence the development of a uniform outer shell of martensite which has uniform compressive stresses contributing to rod straightness. Selection of the appropriate low alloy composition in conjunction with the high velocity quenching of the bar also ensures that the core content remains at least at about 99% pearlite to give the bar the necessary toughness when used as a grinding rod. The technology is capable of providing a tough rod structure without having to resort to the inclusion of exotic alloys in the steel bar. The advantage of providing a crack arresting ring in the controlled end portion is an added feature which is achievable by the post end treatment of this invention. A further advantage of the soft end portion is to increase the overall wear resistance of the grinding rod by virtue of the controlled engineered soft ends.

Although preferred embodiments of the invention have been described herein in detail, it will be understood by those skilled in the art that variations may be made thereto without departing from the spirit of the invention or the scope of the appended claims.

What is claimed is:

1. A grinding rod chemistry for enhancing wearability and durability of a steel rod comprises:

carbon 0.70–1.00% by weight;

manganese 0.60–1.00% by weight;

silicon 0.10–0.40% by weight;

chromium 0.25–1.04% by weight;

molybdenum 0.01–0.25% by weight; and balance essentially iron; and with the proviso that a combination of carbon, molybdenum and chromium within the above ranges are selected as follows to provide a non-bainitic core:

a) at the lower 0.7% carbon with a minimum of 0.01% molybdenum, chromium is equal to or less than 1.04% and with a maximum of 0.25% molybdenum, chromium is equal to or less than 0.43%; and b) at the upper 1.00% carbon, with a minimum of 0.01% molybdenum, chromium is equal to or less than 0.80% and with a maximum of 0.25% molybdenum, chromium is equal to or less than 0.28%, said rod being characterized by:

i) a core of greater than 99% pearlite having a hardness less than 45 Rockwell C;

ii) an outer shell of tempered martensite having a hardness of greater than 55 Rockwell C and a uniform annular thickness greater than about 1.25 cm;

iii) a 10 cm to 15 cm soft end having a hardness less than 35 Rockwell C; and iv) wherein each soft end has an intermediate portion of a hardness less than 25 Rockwell C to provide thereby a ring with improved crack arresting properties.

2. A grinding rod of claim 1 wherein said rod is essentially straight by virtue of uniform stresses in said outer annular shell of tempered martensite.

3. A grinding rod of claim 1 produced by a process comprising:

i) reheating a formed steel bar of said chemistry to above its austenitising temperature to produce a reheated bar of substantially uniform reheat temperature;

ii) transferring with minimal cooling said reheated bar to an open tubular quench vessel which is capable of enclosing an entire bar length, closing said vessel to provide a quench liquid tight seal about said bar while securing said bar in said vessel to minimize bar warping in said vessel during quenching;

iii) introducing quench water into an inlet end of said vessel and passing said quench liquid along said vessel at high surface velocities exceeding 4 meters per second relative to bar surface to minimize thereby production of steam along the bar length and ensure uniform heat removal and removing quench water at an outlet end of said vessel;

iv) quenching said bar in said vessel for a period of time which provides a bar surface equalization temperature when removed from said vessel of less than 350° C. and greater than 150° C. to provide a uniform annular layer for said hard outer shell of tempered martensite and said softer core of pearlite where the end surface hardness is consistent with said hard tempered martensite shell, said developed uniform outer shell of martensite producing uniform residual stress contributing to rod straightness;

v) reheating each end portion of said bar in a furnace to elevate said soft end portion including its core to the austenitising temperature, air cooling each said end portion to provide said end portion hardness of less than 35 Rockwell C.

4. A process for producing a grinding rod having a core of greater than 99% pearlite having a hardness less than 45 Rockwell C and an outer shell of tempered martensite having a hardness greater than 55 Rockwell C and a uniform annular thickness greater than about 1.25 cm, said process comprising:

i) reheating a formed steel bar to above its austenitising temperature in a controlled manner to produce a reheated bar of substantially uniform reheat temperature, said steel bar having the following chemistry:

carbon 0.70–1.00% by weight;

manganese 0.60–1.00% by weight;

silicon 0.10–0.40% by weight;

chromium 0.25–1.04% by weight;

molybdenum 0.01–0.25% by weight; and balance essentially iron; and with the proviso that a combination of carbon, molybdenum and chromium within the above ranges are selected as follows to provide a non-bainitic core:

a) at the lower 0.7% carbon with a minimum of 0.01% molybdenum, chromium is equal to or less than 1.04% and with a maximum of 0.25% molybdenum, chromium is equal to or less than 0.43%; and b) at the upper 1.00% carbon, with a minimum of 0.01% molybdenum, chromium is equal to or less than 0.80% and with a maximum of 0.25% molybdenum, chromium is equal to or less than 0.28%;

ii) transferring with minimal cooling said reheated bar to an open tubular quench vessel which is capable of enclosing an entire bar length, closing said vessel to provide a quench liquid tight seal about said bar while securing said bar in said vessel to minimize bar warping in said vessel during quenching;

iii) introducing quench water into an inlet end of said vessel and passing said quench liquid along said vessel at high surface velocities exceeding 4 meters per second relative to bar surface to minimize thereby production of steam along the bar length and ensure uniform heat removal and removing quench water at an outlet end of said vessel;

iv) quenching said bar in said vessel for a period of time which provides a bar surface equalization temperature when removed from said vessel of less than 350° C. and greater than 150° C. to provide a uniform annular layer for said hard outer shell of tempered martensite and said softer core of pearlite where the end surface hardness is consistent with said hard tempered martensite shell, said developed uniform outer shell of martensite producing uniform residual stress contributing to rod straightness.

5. A process of claim 4 wherein said quench water is at a temperature in the range of 10° C. to 40° C.

6. A process of claim 5 wherein said quench water surface velocity is in the range of 5 m/sec to 8 m/sec.

7. A process of claim 6 wherein said rod has a diameter ranging from about 7.5 cm to about 10.1 cm and said period of quench time ranges from 110 seconds to 160 seconds.

8. A process of claim 7 wherein said quenching step and said chemistry provide a tempered martensite shell of approximately 1.60 cm thickness.

9. A process of claim 4 wherein said steel bar has been subjected to a degassing step during bar manufacture to minimize hydrogen in rolled bar stock.

10. A process of claim 4 comprising producing said grinding rod of said chemistry with a 10 cm to 15 cm soft end and having a hardness less than 35 Rockwell C, said process comprising:

v) reheating each end portion of said bar in a furnace to elevate, in a controlled manner, said end portion including its core to the austenitising temperature, and air cooling each said end portion to provide each said end portion with a hardness of less than 35 Rockwell C.

11. A process of claim 10 wherein said furnace is an induction furnace for localizing heating of said bar end to the first 10 cm to 15 cm.

12. A process of claim 10 wherein said bar end has a surface hardness of less than 30 Rockwell C to provide crack arresting properties and an abrupt transition to said harder tempered martensite shell.

13. A process of claim 10 wherein said bar end has an annular intermediate section of reduced hardness relative to remainder of said bar end to provide a ring with improved crack arresting properties.

14. A process of claim 10 wherein said bar end has a microstructure comprised substantially of pearlite and free of bainite and martensite.

15. A process of claim 10 wherein the quench water temperature is in the range of 30° to 35° C.

* * * * *